US006148901A

United States Patent [19]

Damasse et al.

[11] Patent Number: 6,148,901

[45] Date of Patent: Nov. 21, 2000

[54] PLANT FOR THE TWIN-ROLL CONTINUOUS CASTING OF METAL STRIP

[75] Inventors: Jean-Michel Damasse, Isbergues; Paul Victor Riboud, Metz, both of France

[73] Assignees: Usinor, Puteaux, France; Thyssen Staiti Aktiengesellschaft, Allemagne, United Kingdom

[21] Appl. No.: 09/060,177

[22] Filed: Apr. 15, 1998

[30] Foreign Application Priority Data

Apr. 29, 1997 [FR] France ..... 97 05247

[51] Int. Cl.[7] ..... B22D 11/06

[52] U.S. Cl. ..... 164/428; 164/480

[58] Field of Search ..... 164/480, 428

[56] References Cited

U.S. PATENT DOCUMENTS 5,660,224 8/1997 Barbe et al. ..... 164/428

FOREIGN PATENT DOCUMENTS 2727338 5/1996 France .
61-7049 1/1986 Japan ..... 164/428
2-52148 2/1990 Japan .
3-248747 11/1991 Japan .
7-290202 11/1995 Japan .

OTHER PUBLICATIONS

Patent Abstract of Japan, vol. 096, No. 003, Mar. 29, 1996 & JP 07 290202 A (Nippon Steel Corp), Nov. 7, 1995 *abstract*.

Patent Abstract of Japan, vol. 016, No. 044 (M–1207), Feb. 4, 1992 & JP 03 248747 A (Nippon Steel Corp), Nov. 6, 1991, *abstract*.

*Primary Examiner*—Kuang Y. Lin

*Attorney, Agent, or Firm*—Nixon Peabody LLP; Thomas W. Cole

[57] ABSTRACT

A plant for the continuous casting of metal strip (13) between two, internally cooled, counterrotating rolls (1, 1') with horizontal axes, the surfaces (2, 2') of which define a casting space (3) which is closed off laterally by two refractory side walls (4, 4') provided with means for pressing them, at least intermittently, against the ends (5, 5', 5'', 5''') of said rolls (1, 1'), and having a shroud (6) which overhangs the casting space (3), horizontal clearances "ϵ" being provided between said side walls (4, 4') and said shroud (6), wherein said side walls and/or said shroud include means for reflecting, throughout the casting run, the radiation emanating from the portions (16) of said liquid metal (9) which lie in the immediate vicinity of said side walls (4, 4') back onto the surface (8) of the liquid metal (9) present in said casting space (3), preventing said radiation from penetrating said horizontal clearances "ϵ".

4 Claims, 3 Drawing Sheets

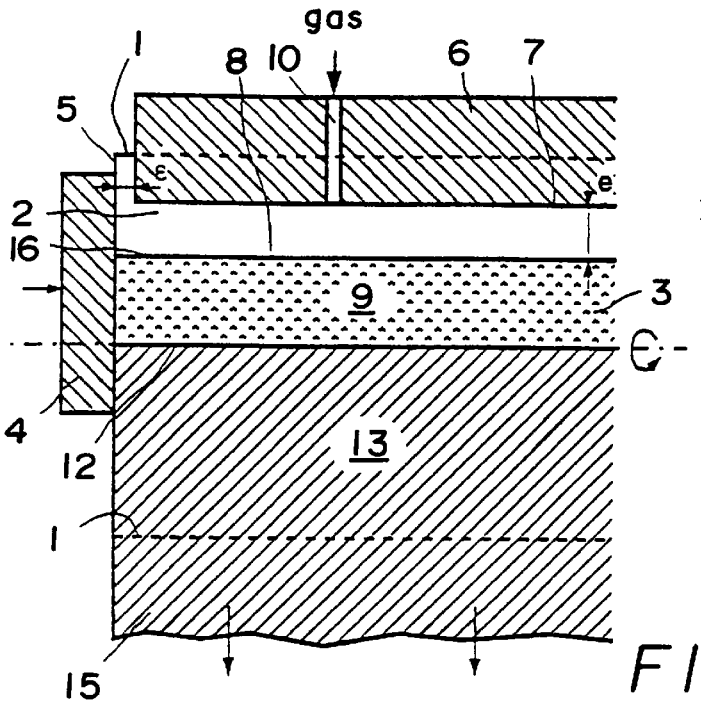
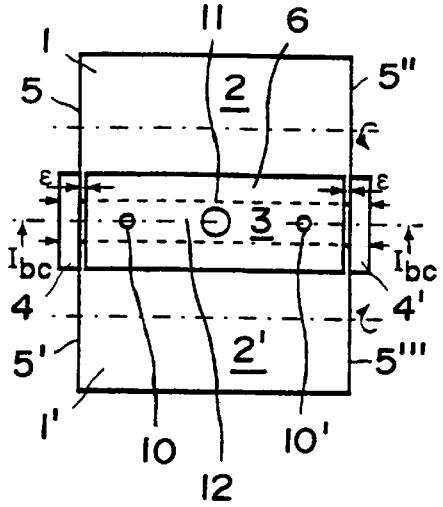
FIG. 1a
(Prior Art)
FIG. 1b
(Prior Art)
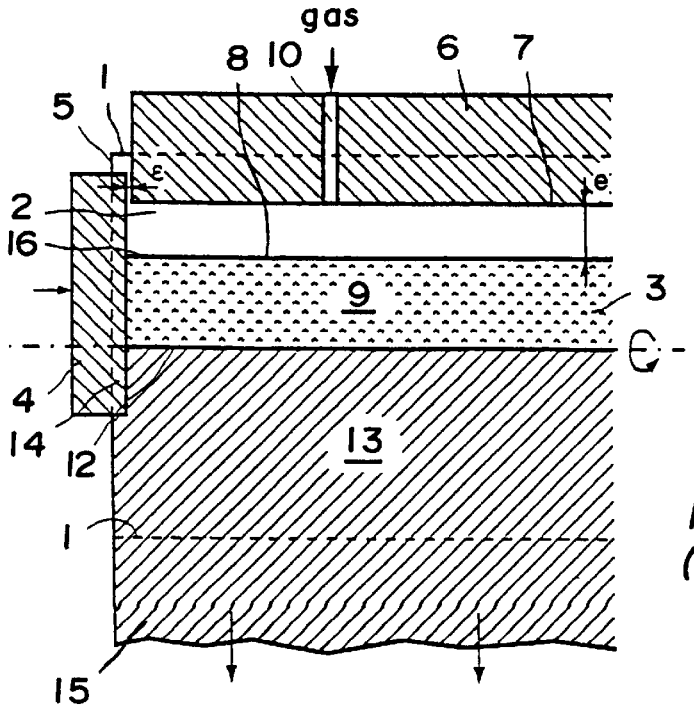
FIG. 1c
(Prior Art)

PLANT FOR THE TWIN-ROLL CONTINUOUS CASTING OF METAL STRIP

FIELD OF THE INVENTION

The invention relates to the field of the continuous casting of metals, and more particularly the continuous casting of metal strip a few mm in thickness between two internally cooled counterrotating rolls with horizontal axes.

PRIOR ART

In this type of metal-strip continuous casting, whose application to the casting of steel is in the process of being industrialized, the casting space is defined by the side surfaces of the rolls. It is closed off laterally by two plates made of refractories, called "side walls", which are either applied against the ends of the rolls, called "end faces", or held at a very short distance from the end faces (a fraction of one mm) for the purpose of avoiding liquid metal leaking out of the casting space. In fact, even if it is intended ideally to keep the side walls at a short distance from the end faces, for the purpose of limiting their wear and their cooling in contact with the rolls, it is, in any case, periodically necessary to press the side walls against the end faces. The purpose of this periodic pressing is to restore, by mechanical wear, the surfaces of the side walls impaired by contact with the liquid metal which has infiltrated between them and the end faces, so as to make them again correspond perfectly with those of the end faces. Thus, it is inevitable that the part of each side wall which does not rub against the end faces, and is therefore never subjected to high mechanical wear, penetrates more and more deeply between the cooled side surfaces of the rolls which define the casting space. This penetrating part is called "positive insert".

Moreover, it is necessary to provide a device for shrouding the casting space so as to maintain above the liquid steel an atmosphere which is as free as possible of oxygen. In this way, it is sought to avoid atmospheric reoxidations of the metal which would form from the nonmetallic impurities contaminating the metal. Another function of this shrouding device is to stop the radiation emanating from the surface of the liquid metal and to reflect it so as to limit the cooling of the metal. In order to fulfill these functions better, the lower refractory face of the shrouding device usually lies at a distance of a few tens of mm from the nominal level of the surface of the liquid metal present in the casting space. Generally, direct contact between the shrouding device and the rolls is prevented, so as to avoid deterioration, by rubbing, of the surface finish of the latter, and slight clearance is therefore maintained between them. The space separating the shroud and the liquid metal and the rolls is inerted using an inert gas (nitrogen, argon or helium) or a mixture of such gases. An example of such a shrouding device is described, for instance, in document FR 2,727,338.

Despite all the precautions which are usually taken to limit the cooling of the liquid steel near the side walls, in particular the strong preheating of the side walls before starting the casting run, it is not generally possible to avoid the appearance of excessive solidification of metal on the ends of the rolls compared with the remainder of their width (which excessive solidification will be called "oversolidification"). Consequently, in the nip (the region where the separation between the rolls is smallest and where the "shells" which solidify on each of the rolls join together to form the cast strip), particularly high stresses are exerted on the ends of the rolls and on the side walls because of the abnormally high thickness, called "excess thickness", of the edges of the strip caused by this oversolidification. These stresses consequently cause excessively rapid deterioration of the lower parts of the side walls, which may lead to imperfect sealing of the casting space, and, when the overthicknesses become momentarily much too great, require the rolls to be moved slightly further apart in order to avoid having to roll the edges of the strip. In both cases, there is a high risk of forming defects making the strip unusable and, if there be significant leakage of liquid metal out of the casting space, due to deterioration of the side walls, it is necessary to stop casting.

SUMMARY OF THE INVENTION

The object of the invention is to provide novel means for reducing the oversolidification near the ends of the rolls so as to eliminate the overthicknesses at the ends of the strip which they usually cause.

For this purpose, the subject of the invention is a plant for the continuous casting of metal strip between two, internally cooled, counterrotating rolls with horizontal axes, the surfaces of which define a casting space which is closed off laterally by two refractory side walls provided with means for pressing them, at least intermittently, against the ends of said rolls, and having a shroud which overhangs the casting space, horizontal clearances "$\epsilon$" being provided between said side walls and said shroud, wherein said side walls and/or said shroud include means for reflecting, throughout the casting run, the radiation emanating from the portions of said liquid metal which lie in the immediate vicinity of said side walls back onto the surface of the liquid metal present in said casting space, preventing said radiation from penetrating said horizontal clearances "$\epsilon$".

As will have been understood, the invention consists in configuring the side walls and the shroud for protecting the casting space so as permanently to prevent, during casting, the surface of the liquid metal present in the immediate vicinity of the side walls from radiating to the outside of the casting plant across the gaps which separate the shroud from the side walls.

DESCRIPTION OF THE DRAWINGS

The invention will be more clearly understood on reading the description which follows, with reference to the following appended figures:

FIG. 1 which shows diagrammatically a plant for the twin-roll continuous casting of metal strip according to the prior art, as it is at the start of casting, in a top view in FIG. 1*a* and a partial front view in longitudinal cross-section on Ibc—Ibc in FIG. 1*b* and, as it is at a subsequent stage of the casting, in FIG. 1*c*, in partial front view in longitudinal cross-section on Ibc—Ibc;

The plant for the continuous casting of metal strip according to the prior art shown very diagrammatically in FIG. 1 (FIG. 1*b* and 1*c* show only one of its sides) is composed of two closely spaced rolls 1, 1' with horizontal axes, these rolls being internally cooled and rotated in opposite directions by means, not shown. Their side surfaces 2, 2' define, between them, a casting space 3 closed off laterally by two refractory side plates 4, 4' which, in the example given, are pressed by conventional means, not shown, against the end faces 5, 5', 5", 5'" of the rolls 1, 1'. The casting space 3 is covered by a shroud 6, at least the lower face 7 (that turned toward the casting space 3) of which is made of refractories. It is shaped and held in place so that its lower face 7 matches the shape of the side surfaces 2, 2' of the rolls 1, 1' with a slight clearance and overhangs the surface 8 (not shown in FIG. 1*a*) of the liquid metal 9 present in the casting space 3 at a nominal distance "e" which ideally is a few tens of mm (for example, 30 mm). Preferably, it is transpierced by one or more perforations 10, 10' through which an inert gas is blown in order to inert the casting space 3, so as to prevent the liquid metal 9 from being reoxidized by atmospheric oxygen. Finally, the shroud 6 has, at its centre, a perforation 11 allowing the introduction into the casting space 3 of the nozzle (not shown) which supplies it with liquid metal 9. Conventionally, the liquid metal 9 solidifies against the cooled side surfaces 2, 2' of the rolls 1, 1' and forms solidified shells thereon. These shells join together in the nip 12 to form the solid strip 13 which is continually extracted from the casting plant by known means, not shown.

FIGS. 1*a* and 1*b* show the plant at the start of casting, therefore at a moment when the side walls 4, 4' are new and have not yet become worn by rubbing against the end faces 5, 5', 5", 5'". The side walls 4, 4' and the shroud 6 are therefore separated by a horizontal clearance "ϵ", the initial value of which is, for example, about 15 mm. During casting, those parts of the side walls 4, 4' which are in contact with the end faces 5, 5', 5", 5'" become worn by rubbing and, as mentioned, those portions of the side walls 4, 4' which are not subjected to this wear penetrate gradually into the casting space 3, forming a positive insert 14. As a result, the horizontal clearance "ϵ" between the positive insert 14 and the shroud 6 gradually decreases during casting, as the other parts of the side walls 4, 4' become progressively worn by rubbing. It is therefore necessary to provide a high enough initial value of the horizontal clearance "ϵ" so that, during casting, the side walls 4, 4' cannot come into contact with the shroud 6 before the end of casting, as such contact would block the movement of the side walls 4, 4'. The initial value of "ϵ" must therefore be greater than or equal to the maximum anticipated wear of the side walls 4, 4'.

Figure 2B:
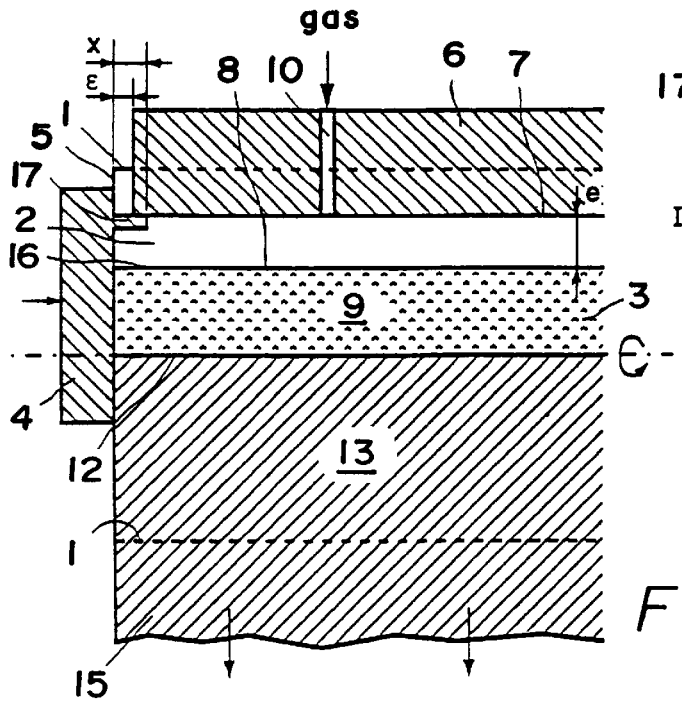
FIG. 2 shows diagrammatically a first embodiment of a plant according to the invention, as it is at the start of casting, in a top view in FIG. 2*a* and in a partial front view in longitudinal cross-section on IIbc—IIbc in FIG. 2*b* and, as it is at a subsequent stage of the casting, in FIG. 2*c*, in a partial front view in longitudinal cross-section on IIbc—IIbc.

As mentioned, this maximum wear may reach relatively high values, such as 15 mm. Those skilled in the continuous casting of thin steel strip have tried by various methods to reduce the excessive solidification on the edges 15 of the strip 13. Mention may be made of choosing refractories which combine as far as possible good insulating properties and good wear resistance for forming those parts of the side walls 4, 4' subjected to the rubbing of the end faces 5, 5', 5", 5'", increasing the pre-heating of the side walls 4, 4' before casting, or heating the side walls 4, 4' during the actual casting. The inventors have come to the conclusion that, in the current state of development of the technology, the predominant factor in the persistence of the formation of excessive thickness of metal that has solidified in the region of the edges 15 of the strip 13 is the radiation from the liquid metal 9 to the outside of the plant through the horizontal clearances "ϵ" separating the shroud 6 from the side walls 4, 4'. That portion 16 of metal which forms mainly the edge 15 of the strip 13, and the radiation from which is not reflected toward it by the shroud 6, cools substantially more quickly than the remainder of the metal 9 present in the casting space 3 and therefore forms a thicker solidified shell. This oversolidification phenomenon is particularly marked in the regions surrounding those points in the casting space called "quadruple points". These quadruple points are the points where the atmosphere, the surface 2, 2' of a casting roll 1, 1', a side wall 4, 4' and the surface 8 of the liquid steel 9 meet, and it is in these regions that the solidification of the edges 15 of the strip 13 is initiated. To be sure, this problem tends to diminish over the course of the casting run with the gradual reduction in the horizontal clearance "ϵ". However, on the one hand, it is right at the beginning of casting, while the plant is not yet under very stable thermal conditions, that the risks of a serious incident due to oversolidification on the edges 15 of the strip 13 are the greatest. On the other hand, it is not advantageous to reduce the horizontal clearance "ϵ" very rapidly, as otherwise there would be a risk of having to interrupt the casting run before its normal term if "ϵ" were to become prematurely zero as a result of the side walls 4, 4' wearing more significantly than planned.

According to the invention, it is desired to prevent the radiation emanating from that portion 16 of the liquid metal 9 which forms the edges 15 of the strip 13 from escaping out of the casting plant, without being reflected back onto the liquid metal 9. To do this, the shroud 6 and the side walls 4, 4' are configured so that all of the liquid metal 9 present in the casting space 3, including on its edges, are overhung by a refractory screen throughout the duration of casting.

DESCRIPTION OF THE PREFERRED EMBODIMENTS

According to a first embodiment of the invention, shown in FIG. 2, this screen is formed by an appendage which is oriented approximately horizontally and integral with each of the side walls 4, 4', the shroud 6 permanently resting on said appendage or overhanging it. According to a second embodiment of the invention, each side edge of the shroud 6 extends beyond the casting space 3 and is set permanently into a recess provided at the top of each of the side walls 4, 4'. Said recess must be sufficiently deep to allow the side wall 4, 4' to move gradually toward the rolls 1, 1' until its maximum acceptable wear, without it butting against the shroud 6. In this second embodiment, it is therefore the shroud 6 itself which forms the screen overhanging the edge of the casting space 3.

Figure 2A:
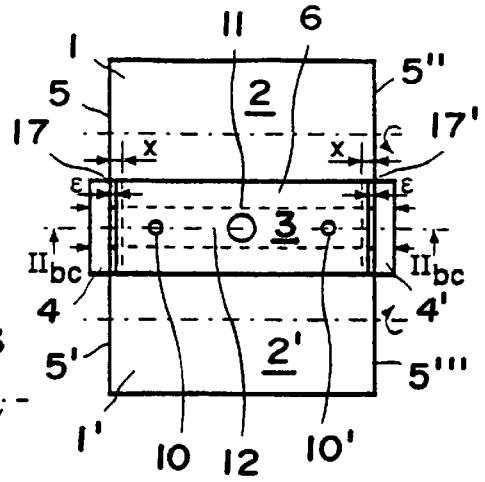
Figure 2C:
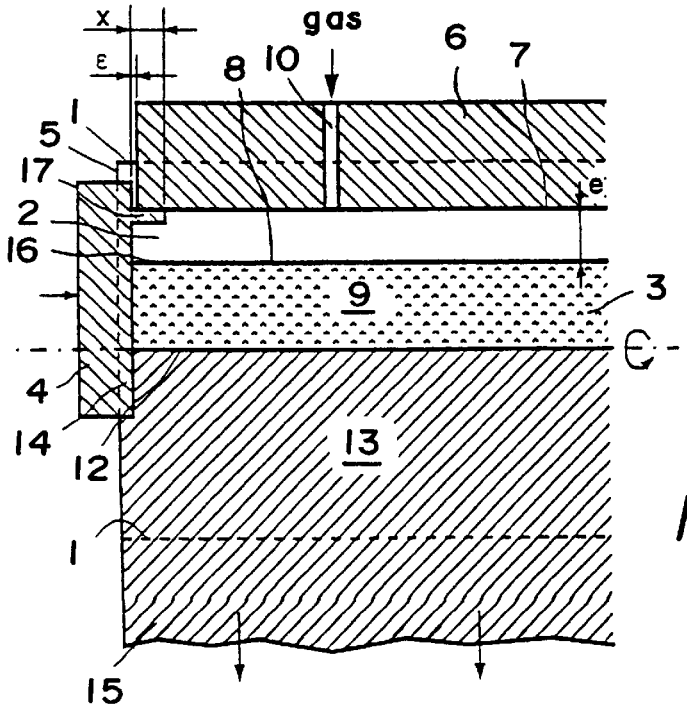

In the first aforementioned embodiment of the invention, shown in FIG. 2 (its elements in common with the configuration according to the prior art of FIG. 1 are denoted by the same references), the shroud 6 is not modified, compared to the prior art, whether in its design or its dimensions. The modification relates to the side walls 4, 4', which are each provided with a horizontal appendage 17, 17' which extends over all (as in the example shown) or only part of their width, the essential point being that the portions 16 of the liquid metal 9 which are in the immediate vicinity of the side walls 4, 4' are overhung over their entire length by said appendages 17, 17'. As mentioned, these appendages 17, 17' act as a screen for the radiation emanating from said portions 16 of the liquid metal 9 and prevent said portions 16 from cooling so as to form edges 15 which are thicker than the rest of the strip 13. The position in terms of height and the width "x" of the appendages 17, 17' are chosen in such a way that, as may be seen in FIGS. 2*a* and 2*b*, right from the start of casting the edges of the shroud 6 rest on the appendages 17, 17' or overhang them without touching them (depending on whether it is desired for there to be contact between them or not). In other words, "x" must therefore be greater than or equal to the inital value of "ϵ". In this way, all points on the surface 8 of the liquid metal 9 present in the casting space 3 radiate, throughout casting, directly onto a refractory component, either onto the shroud 6 or onto one of the appendages 17, 17'. As may be seen in FIG. 2*c*, during casting, while the side walls 4, 4' are wearing and the positive inserts 14 are being formed, the side walls 4, 4' gradually move toward the shroud 6 and, when assembling the plant, care was taken for the horizontal clearance "ϵ" not to be able to become zero during casting, taking into account the maximum anticipated wear of the side walls 4, 4'.

As a variant, the lower surfaces of the appendages 17, 17' may be given a configuration allowing the radiation to be concentrated preferably onto the quadruple points.

Figure 3B:
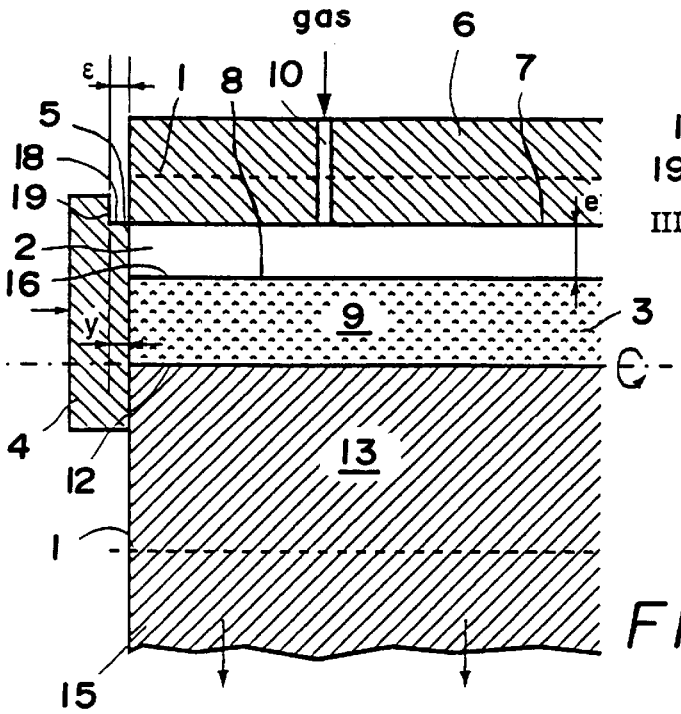
FIG. 3 shows diagrammatically a second embodiment of a plant according to the invention, as it is at the start of casting, in a top view in FIG. 3*a* and in a partial front view in longitudinal crosssection on IIIbc—IIIbc in FIG. 3*b* and, as it is at a subsequent stage of the casting, in FIG. 3*c*, in a partial front view in longitudinal cross-section on IIIbc—IIIbc.
Figure 3A:
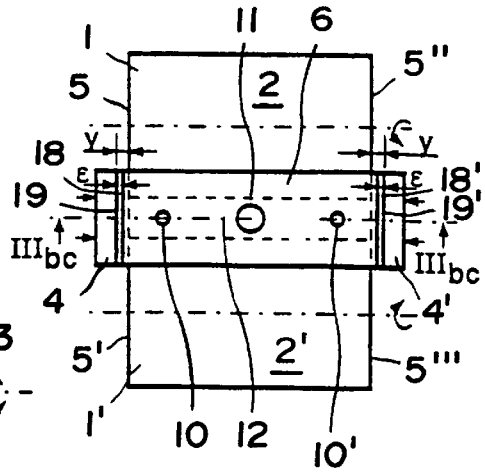
Figure 3C:
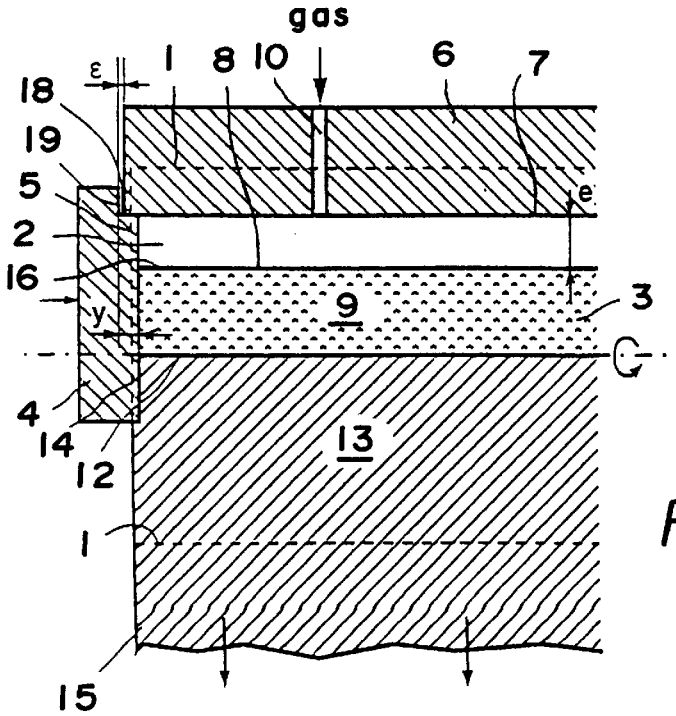

In the second aforementioned embodiment of the invention, shown in FIG. 3 (its elements which are common to the configuration of the prior art of FIG. 1 are denoted by the same references), the width of the shroud 6 is increased so that it extends laterally beyond the casting space 3. The edges of the shroud 6 are set into recesses 18, 18' of depth "y" which are each provided in the upper part of a side wall 4, 4'. Moreover, the horizontal clearance "ϵ" existing between the shroud 6 and the side walls 4, 4' (and which, again, is at least equal to the maximum anticipated wear of the side walls 4, 4' during casting) is measured, in this case, between each edge of the shroud 6 and the vertical bottom 19, 19' of the recess 18, 18' which corresponds to it. Consequently, the horizontal depth "y" of the recesses 18, 18' must be at least equal to, and preferably greater than, the initial value of "ϵ". At the start of casting, as may be seen in FIGS. 3*a* and 3*b*, the edges of the shroud 6 are opposite the recesses 18, 18' in the side walls 4, 4', resting on the latter as shown, or being maintained a short distance therefrom. During casting, as shown in FIG. 3*c*, as the side walls 4, 4' gradually become worn and the positive inserts 14 penetrate the casting space 3, the horizontal clearance "ϵ" gradually decreases, as in the previous configurations. According to the invention, the portions 16 of the liquid metal 9 present in the casting space 3 which lie in the immediate vicinity of the side walls 4, 4' radiate onto the lower face 7 of the shroud 6 from the start to the end of casting. These portions therefore do not solidify substantially differently from the rest of the liquid metal 9, and the edges 15 of the strip 13 are therefore not excessively thick compared to the rest of the strip 13.

Of course, it is possible to imagine configurations of the side walls 4, 4' and of the shroud 6 which are other than those just described and shown, while remaining within the spirit of the invention. The essential point is that, despite the existence of the horizontal clearances "ϵ" separating the side walls 4, 4' from the shroud 6, the entire surface 8 of the liquid metal 9 present in the casting space 3 permanently radiates onto a surface which reflects this radiation back onto the liquid metal 9, this surface is either integral with a side wall 4, 4' and/or with the shroud 6 and that these parts of the plant are shaped so as to leave the clearances "ϵ" to change freely during casting. In this way, the problem of the formation of excess thicknesses at the edges can be solved without adding further components to the casting plant and without having to modify the principle by which the side walls 4, 4' are governed since the clearances "I" can change freely, as previously. Likewise, it goes without saying that the invention may be applied to a twin-roll casting of metals other than steel.

What is claimed is:

1. A plant for the continuous casting of metal strip comprising two internally cooled, counter-rotating rolls with horizontal axes for casting metal strip therebetween, the surfaces of said rolls defining a casting space which is closed off laterally by two refractory side walls pressed at least intermittently against ends of said rolls, a shroud overhanging the casting space, at least one horizontal clearance being provided between said side walls and said shroud to prevent said side walls from contacting said shroud as a result of wear between said side walls and the ends of said rolls, wherein one of said side walls and said shroud includes a means for preventing radiation emanating from portions of liquid metal which lie in the immediate vicinity of said side walls from escaping through said horizontal clearance wherein said means includes appendages which are oriented approximately horizontally and are connected to each of the side walls.

2. The plant as claimed in claim 1, wherein lower surfaces of said appendages are shaped so as to reflect said radiation into side regions of the casting space which surround quadruple points.

3. A plant for the continuous casting of metal strip comprising two internally cooled, counter-rotating rolls with horizontal axes for casting metal strip therebetween, the surfaces of said rolls defining a casting space which is closed off laterally by two refractory side walls pressed at least intermittently against ends of said rolls, a shroud overhanging the casting space, at least one horizontal clearance being provided between said side walls and said shroud to prevent said side walls from contacting said shroud as a result of wear between said side walls and the ends of said rolls, wherein one of said side walls and said shroud includes a means for preventing radiation emanating from portions of liquid metal which lie in the immediate vicinity of said side walls from escaping through said horizontal clearance, wherein said means includes recesses provided in an upper part of said side walls which receive edges of said shroud, said horizontal clearance being provided between said edges of said shroud and bottom portions of said recesses.

4. A plant for the continuous casting of metal strip comprising two internally cooled, counter-rotating rolls with horizontal axes for casting metal strip therebetween, the surfaces of said rolls defining a casting space which is closed off laterally by two refractory side walls pressed at least intermittently against ends of said rolls, a shroud overhanging the casting space, at least one horizontal clearance being provided between said side walls and said shroud to prevent said side walls from contacting said shroud as a result of wear between said side walls and the ends of said rolls, wherein one of said side walls and said shroud includes a means for preventing radiation emanating from portions of liquid metal which lie in the immediate vicinity of said side walls from escaping through said horizontal clearance, wherein said means includes horizontally disposed walls connected to each of the side walls.

* * * * *